US005890115A

United States Patent [19]

Cole

[11] Patent Number: 5,890,115

[45] Date of Patent: Mar. 30, 1999

[54] SPEECH SYNTHESIZER UTILIZING WAVETABLE SYNTHESIS

[75] Inventor: Terry Lynn Cole, Austin, Tex.

[73] Assignee: Advanced Micro Devices, Inc., Sunnyvale, Calif.

[21] Appl. No.: 813,473

[22] Filed: Mar. 7, 1997

[51] Int. Cl.[6] ..... G10L 5/02; G10L 9/00

[52] U.S. Cl. ..... 704/258

[58] Field of Search ..... 704/258

[56] References Cited

U.S. PATENT DOCUMENTS

| | | | |
|---|---|---|---|
| 5,228,087 | 7/1993 | Bickerton | 704/232 |
| 5,278,943 | 1/1994 | Gasper | 704/258 |
| 5,444,818 | 8/1995 | Lisle | 704/258 |
| 5,457,685 | 10/1995 | Champion | 704/258 |

OTHER PUBLICATIONS

Webster's II New Riverside University Dictionary, Def. of "vibrato" and tremolo, Dec. 1994.

*Primary Examiner*—David R. Hudspeth
*Assistant Examiner*—Robert Louis Sax
*Attorney, Agent, or Firm*—Skjerven, Morrill, MacPherson, Franklin & Friel LLP; Ken J. Koestner

[57] ABSTRACT

A wavetable speech synthesis apparatus includes a wavetable memory for defining a plurality of primitive speech sounds. The primitive speech elements are individually assigned to a memory cell designated by an instrument identification in the wavetable memory. Various primitive speech elements are defined and selected from among sound bites, entire words and phrases, frequently-occurring syllables, phonemes or smaller atomic speech elements. The primitive speech elements generate primitive sounds that are played back at a selected pitch, duration, attack velocity and envelope, sustain, and decay velocity and envelope. Various types of speaker qualities or identities are assigned to different frequency ranges of the speech elements. The wavetable memory includes a speech sample database and a speech reference database. The speech sample database supplies speech signals that are processed by the wavetable synthesizer according to information contained in the speech reference database. Reference information in the speech reference database includes various dictionaries, context lists, algorithms, and heuristic rules for guiding decisions relating to selection of primitive speech element, duration, volume and other parameters. The dictionaries store of sampled words and phonics and an encoding designating the pronunciation of the words and phonics. The context lists encode emphasis, lift and emotion that are expressed using variations in volume and addition of vibrato and tremolo.

24 Claims, 9 Drawing Sheets

SPEECH SYNTHESIZER UTILIZING WAVETABLE SYNTHESIS

BACKGROUND OF THE INVENTION

1. Field of the Invention

The present invention relates to a speech synthesizer and speech synthesis technique. More specifically, the present invention relates to a speech synthesizer and operating method that produces an improved, robust sound through utilization of wavetable synthesis techniques.

2. Description of the Related Art

Speech synthesis is the computer generation of sound that resembles human speech. Speech synthesizers have evolved from systems that store and replay speech sounds in the form of simple phonics to more elemental common particles of sound to sound bites including words and phrases. What is common among digital speech processing systems throughout this evolution is the playback of fundamentally flawed speech with lifeless, monotonic sounds that are unnaturally stilted and formal through repetitious playback of a limited library of sounds.

Speech synthesis is accomplished using a speech synthesizer operating on stored sounds and algorithms. The speech synthesizer is a device that converts a numerical code representing a digital speech signal into recognizable speech sounds. The digital speech signal is sampled and recorded speech which is divided into small sound units. The small sound units have characteristics such as pitch, loudness and timbre that are represented as excitation and filter parameter numbers which become a digital code representing speech. Human speech sounds are stored, generally in ROM, EPROM, RAM, CD, or disk memory or are created by a program, and then generated from the stored digital code by excitation of a time-varying digital filter and played over a loudspeaker. A processor supplies overall control of speech production. The process of speech production is typically a digital process up to the point of an analog-to-digital converter, which supplies an analog signal to drive a speaker.

An alternative to the time-varying filter approach is a speech generation system which stores digitized speech data signals, samples the speech data at a constant rate such as an 8 kHz rate, interpolates the data for example to a 100 kHz rate.

In a further alternative embodiment, logarithmically compressed amplitude data are used which are analogous to the data processed by digital telephone systems and result in a data rate of 64 kbits/second with very good sound quality. The time-varying filter techniques supply acceptable speech quality but at a much lower digital input data rate. For example, average rates down to about 1200 bits/second for a ten-pole filter derived from a linear production model of speech. The low data rates for speech generation are possible due to the redundancy in speech and by using a simplified simulator of the human speech-generating system. The vocal tract is simulated by a dozen or so connected pipes of different diameter, and the excitation represented by a pulse stream at the vocal-chord rate for voiced sound or a random noise source for the unvoiced parts of speech. The reflection coefficients at the junctions of the pipes are obtained from a linear prediction analysis of the speech waveform.

The synthesis techniques for synthesizing speech sounds are substantially different from the synthesis techniques which have been developed to synthesize music. Some music synthesis techniques attempt to mimic the acoustical characteristics of an actual musical instrument. Other techniques generate musical sounds based on mathematical analysis and relationships.

One type of synthesis for generating musical sounds is called subtractive synthesis. Subtractive synthesis closely imitates the physical basis of sound generation inherent in acoustic musical instruments. A harmonic-rich periodic signal is generated that contains energy at every partial frequency existing in the sound to be produced. Specific selected frequency components are selectively altered using filters. The filters subtract unwanted frequencies. Electronic filters also supply a frequency-dependent gain so that selected frequencies are enhanced. Subtractive synthesis employs an envelope generator such as a voltage-controlled amplifier or analog multiplier to selectively alter the frequency components of the sound. Subtractive synthesis generates musical sounds in a manner analogous to an actual acoustic instrument so that the physics of the functional basis of the instrument serve as a model for designing the subtractive synthesis technique. Subtractive synthesis using digital techniques is relatively difficult and complex since substantial computations are necessary to generate a harmonic-rich signal that is properly band-limited.

Additive synthesis is a musical synthesis technique in which each partial frequency is generated separately, arbitrarily and independently. The separate partial frequencies are added to form a music signal. Each partial frequency is an integer multiple of the fundamental frequency of the sound to be generated. Additive synthesis functions by providing a plurality of separate oscillators, each of which generally forms a sine wave, and combining the separate sine waves to form a signal that sounds as close as possible to a particular sound.

A further music synthesis method is wavetable synthesis. Wavetable synthesis is a method of generating sound by playing back digitally stored samples. Real musical sounds, performed by actual musical instruments, are sampled and stored in a digital recording format in a storage such as a read-only memory (ROM). The digital sound recordings are sampled and mapped to accurately reproduce the acoustic range of the instrument.

In wavetable synthesis, a sample is a recorded sound stored in a digital data form. An instrument is a selectable entry which defines a particular type of sound corresponding to the sound produced by a specific musical instrument. A wave is a sample or group of samples that are used to reproduce the sound of an instrument over an entire range of frequencies. Instruments are either single-sampled or multi-sampled depending on the timbral characteristics of the corresponding musical instrument, sampling characteristics of the data and sampling system, and playback characteristics of the data and playback system. Some instruments, a flute for example, are typically single-sampled. Other instruments, such as a piano, have a more complex data structure and are nearly always sampled, stored, and played in multiple samples. A program is a set of parameters that are selected to completely define a wavetable synthesizers generation of a particular sound.

Wavetable synthesis may be practiced by sampling and playing back a virtually limitless amount of data. However, system performance, circuit and memory size, and cost are advantageously reduced through many data reduction techniques. One such data reduction technique is termed "looping". Musical sounds are highly sustained and highly repetitive. Looping exploits the sustained and repetitive nature of sound by playing back a section of a sample repeatedly.

Different types of looping are typically supported, including forward looping, reverse looping, bi-directional looping and the like.

Conventional computer-generated speech devices create sounds that are unnaturally stilted and formal due to the repetitious usage of a limited library of sound elements. What is needed is a speech synthesis apparatus and technique that improves the sound of computer-generated speech. What is further needed is a speech synthesis device that generates an interesting, robust-sounding speech.

SUMMARY OF THE INVENTION

It has been discovered that music wavetable synthesis techniques can be advantageously applied to synthesize speech.

In accordance with the present invention, a wavetable speech synthesis apparatus includes a wavetable memory for defining a plurality of primitive speech sounds. The primitive speech elements are individually assigned to a memory cell designated by an instrument identification in the wavetable memory. Various primitive speech elements are defined and selected from among sound bites, entire words and phrases, frequently-occurring syllables, phonemes or smaller atomic speech elements. The primitive speech elements generate primitive sounds that are played back at a selected pitch, duration, attack velocity and envelope, sustain, and decay velocity and envelope.

Various types of speaker qualities or identities are assigned to different frequency ranges of the speech elements. In one example, the lowest octave is assigned to "grandfather" speech samples. The next lowest octave is assigned to "father" speech samples. Then, in order, "grandmother", "mother", "brother", "sister", and "baby" speech samples are assigned to sequentially higher octaves.

In another example, a lowest octave is assigned to a voice expressing the emotion of anger. Then, in order, the emotions of surprise, boredom, normalcy, fright, and the like are assigned to sequentially higher octaves.

The wavetable memory includes a speech sample database and a speech reference database. The speech sample database supplies speech signals that are processed by the wavetable synthesizer according to information contained in the speech reference database. Reference information in the speech reference database includes various dictionaries, context lists, algorithms, and heuristic rules for guiding decisions relating to selection of primitive speech element, duration, volume and other parameters. The dictionaries store of sampled words and phonics and an encoding designating the pronunciation of the words and phonics. The context lists encode emphasis, lift and emotion that are expressed using variations in volume and addition of vibrato and tremolo.

In accordance with an embodiment of the present invention, the wavetable synthesizer forms words from a plurality of different primitive speech elements so that variations from note to note are available to pitch shift the sounds, generating interesting randomness into speech. Multiple primitive speech elements are combined into a word while note variations are used to control speed, emphasis and context. The sounds of speech are further processed by adding tremolo and vibrato.

Many advantages are gained by the described speech synthesis system and operating method. One advantage is that a wavetable speech synthesis device provides for the simple introduction of multiple character voices or multiple tones of voice at a reasonable cost. Another advantage is that effects such as tremolo and vibrato can be used to express a more natural sounding speech by allowing sound pitch, duration and volume to be varied as speech progresses. Volume of speech is selectively dithered to generate a more random speech effect. Other special effects including light echo, chorus and reverb are selectively added to speech to generate a voice having a more realistic sound.

It is further advantageous that the described speech synthesis method and system uses samples that are processed to apply to a specific person or group of people selected from a particular age, gender, occupational, cultural, or other group. Similarly, the samples are processed to apply to particular conditions or situations, such as stressful, frightful, or happy situations. It is advantageous that the described speech synthesis method and system advantageously generates multiple sounds simultaneously such as occurs in case of background conversation with multiple voices active at one time including overlapping of voice sounds.

The wavetable speech synthesizer has advantages over systems that merely play back phoneme, syllabic or word wave patches because the wavetable speech synthesizer can change pitch, duration, tremolo, vibrato and the like during the expression of a note, thereby expressing emotion and emphasis as well as the characters and sounds of speech.

BRIEF DESCRIPTION OF THE DRAWINGS

The features of the described embodiments believed to be novel are specifically set forth in the appended claims. However, embodiments of the invention relating to both structure and method of operation, may best be understood by referring to the following description and accompanying drawings.

DESCRIPTION OF THE PREFERRED EMBODIMENT(S)

Figure 1:
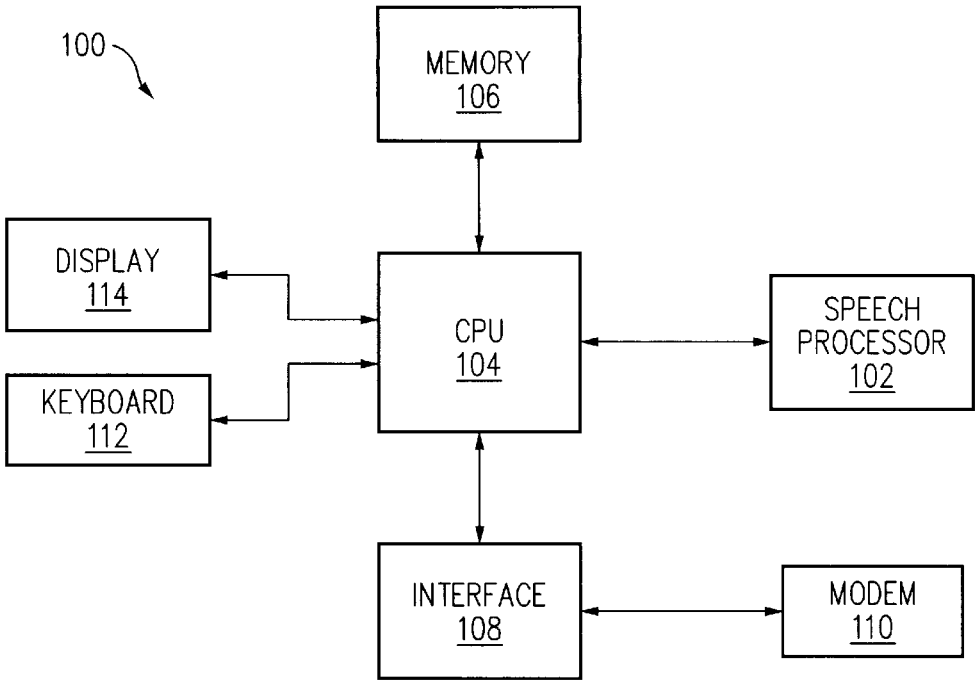
FIG. 1 is a schematic block diagram illustrating a computer system embodiment of a Speech Synthesis device which access stored wavetable speech data from a memory and generate speech signals for performance.
Figure 2:
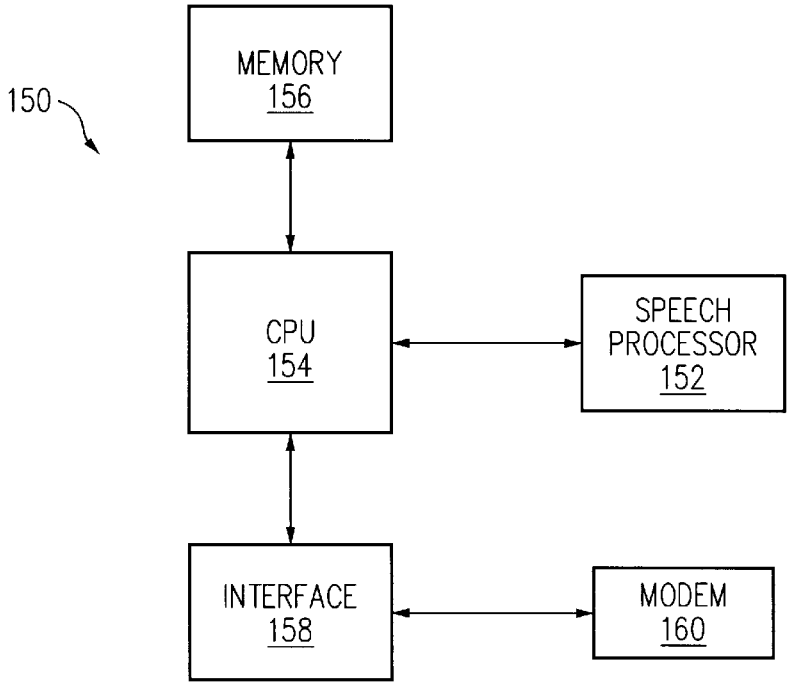
FIG. 2 is a schematic block diagram illustrating a telephonic system embodiment of a Speech Synthesis device which access stored wavetable speech data from a memory and generate speech signals for performance.

Referring to FIGS. 1 and 2, a pair of schematic high-level block diagrams illustrating two embodiments of a Speech Synthesis device 100 which access stored wavetable speech data from a memory and generate speech signals for performance. In an embodiment shown in FIG. 1, a computer system 100 includes the speech processor 102, a central processing unit 104, a memory 106, and an interface 108, connected to a modem 110. The computer system 100 also includes a keyboard 112 and a display 114 forming a user interface. The speech processor 102 performs various functions such as reading back e-mail messages that are textually written for access by the computer system 100. In another application, the speech processor 102 may be used to supply Internet data to a blind user.

In an embodiment shown in FIG. 2, a telephone system 150 includes the speech processor 152 for processing telephonic messages, a central processing unit 154, a memory 156, and an interface 158, connected to a modem 160. One application of the telephone system 150 is a system supplying Internet data to a user by telephone.

Figure 3:
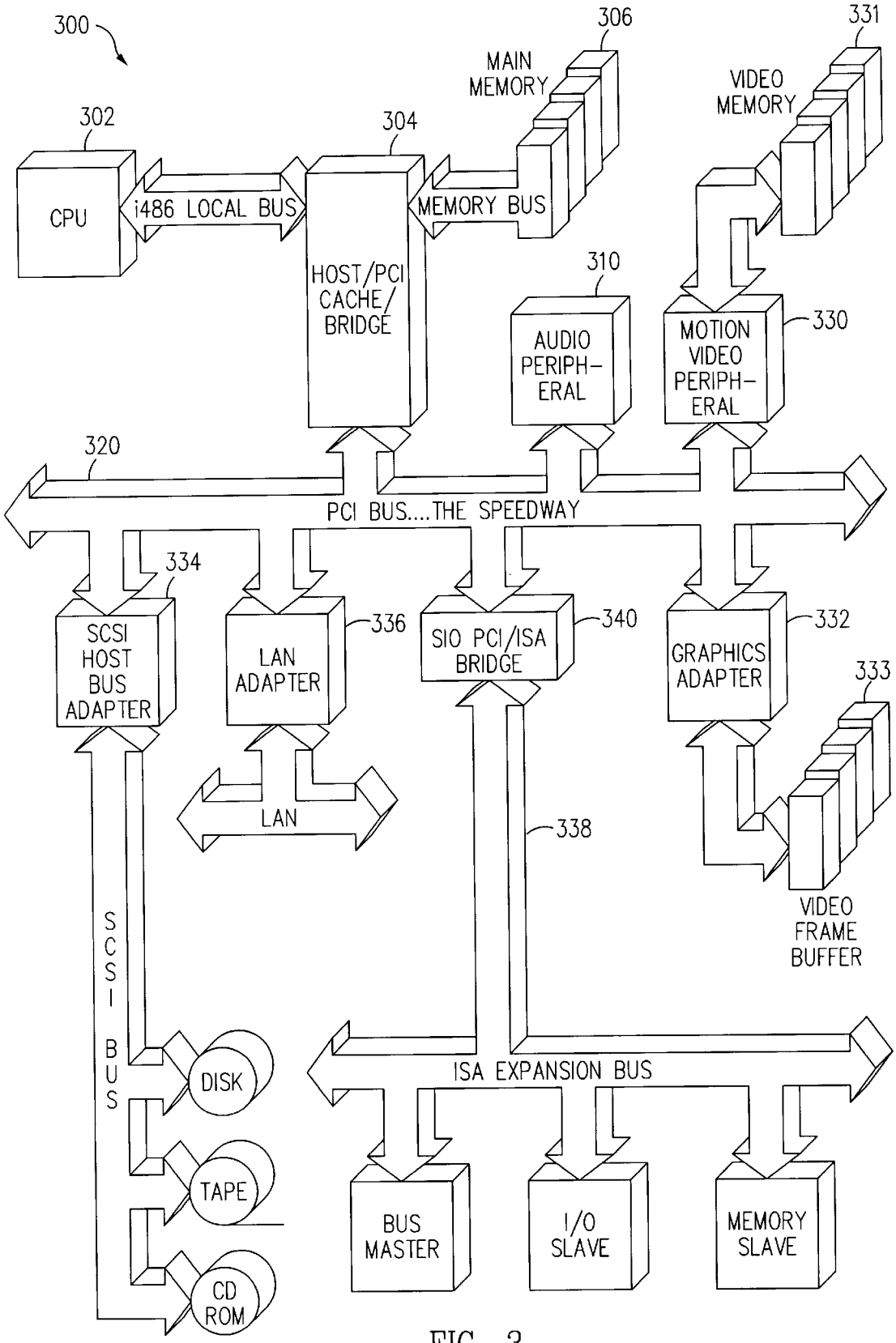
FIG. 3 is a schematic block diagram illustrating a computer system incorporating an audio wavetable synthesizer integrated circuit in accordance with one embodiment of the present invention.

Referring to FIG. 3, a schematic block diagram illustrates an audio performance computer system 300 including an audio wavetable synthesizer integrated -.circuit 310. The computer system 300 employs an architecture based on a bus, such as an Intel™ PCI bus interface 320, and includes a central processing unit (CPU) 302 connected to the PCI bus interface 320 through a Host/PCI/Cache interface 304. The CPU 302 is connected to a main system memory 306 through the Host/PCI/Cache interface 304. A plurality of various special-purpose circuits may be connected to the PCI bus interface 320 such as, for example, the audio wavetable synthesizer integrated circuit 310, a motion video circuit 330 connected to a video memory 331, a graphics adapter 332 connected to a video frame buffer 333, a small systems computer interface (SCSI) adapter 334, a local area network (LAN) adapter 336, and perhaps a expansion bus such as an ISA expansion bus 338 which is connected to the PCI bus interface 320 through an SIO PCI/ISA bridge 340.

The audio wavetable synthesizer integrated circuit 310 accesses musical voice data in several different voices and processes the multiple voice data into a single set of audio signals, such as stereo audio signals, although other audio formats such as three-output, five-output, theater-in-the-home formats and other audio formats are also possible. A voice data signal is a single defined sound such as a note of one instrument, a digital audio file, or a digital speech file.

The audio wavetable synthesizer integrated circuit 310 advantageously supplies high-quality, low-cost audio functions in a personal computer environment. The audio wavetable synthesizer integrated circuit 310 supports logic functions and digital signal processing for performing audio functions typically found in personal computer systems. The audio wavetable synthesizer integrated circuit 310 incorporates a polyphonic music synthesizer and a stereo codec. The audio wavetable synthesizer integrated circuit 310 generates audio signals based on data that is received from the main system memory 306, rather than through a local memory interface. Accordingly, performance of the audio wavetable synthesizer integrated circuit 310 is highly dependent on the bus communication structures of the computer system 300. In one embodiment, the audio wavetable synthesizer integrated circuit 310 addresses up to 64 Mbytes of system memory 306 and generates an audio signal including up to 32 simultaneous voices.

Various embodiments of the computer system 300 use operating systems such as MS-DOS™, Windows™, Windows 95™, Windows NT™ and the like.

Figure 4:
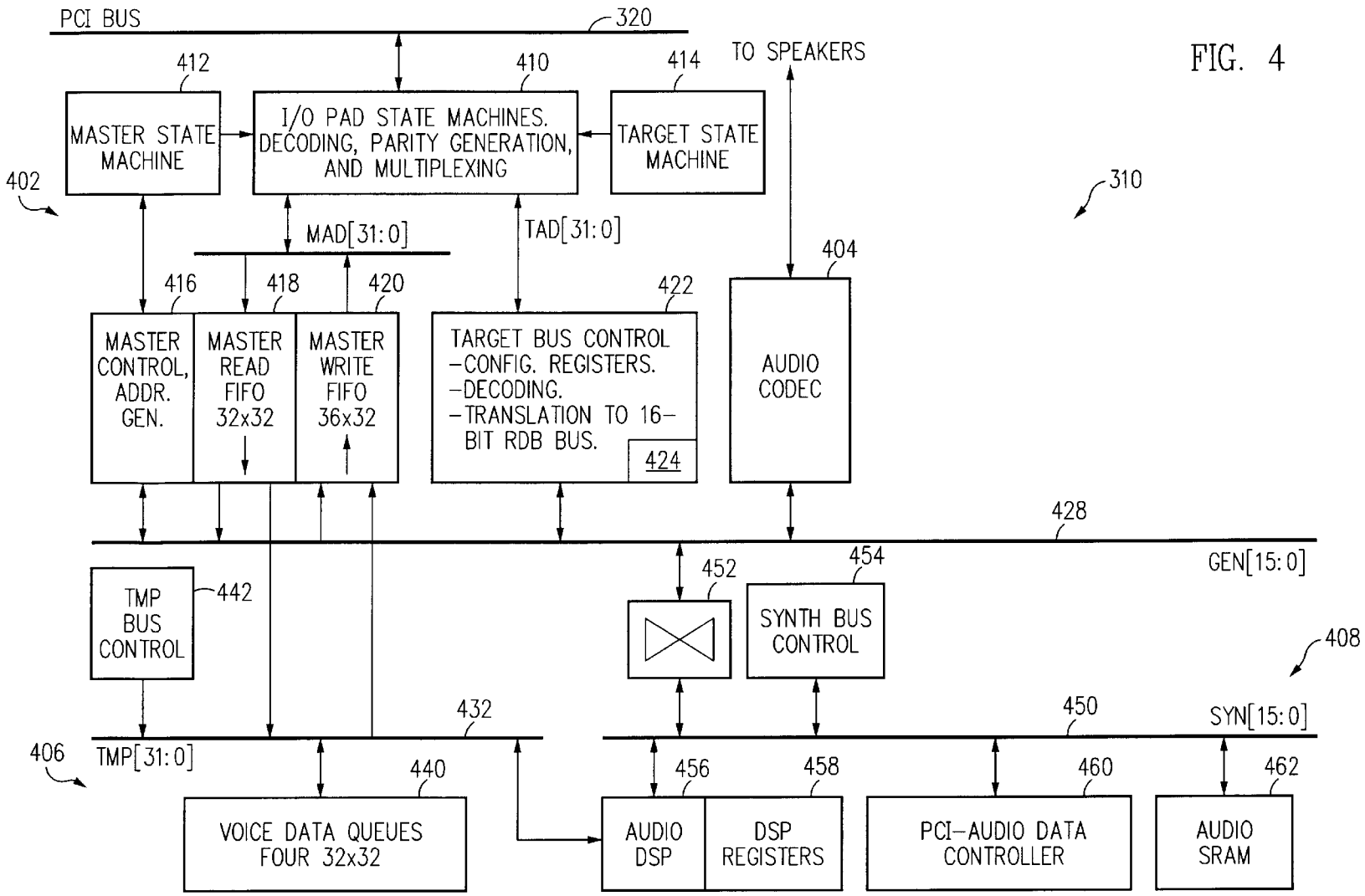
FIG. 4 is a schematic block diagram illustrating an embodiment of the audio wavetable synthesizer integrated circuit for performing logic and digital signal processing supporting audio functions and including a vertical wavetable cache in accordance with an embodiment of the present invention.

Referring to FIG. 4, a schematic block diagram illustrates an embodiment of the audio wavetable synthesizer integrated circuit 310 performs logic and digital signal processing supporting audio functions implemented in a personal computer. The audio wavetable synthesizer 310 is connected to a PCI bus interface 320 and includes a PCI bus interface unit 402, an audio codec 404, an audio cache 406, and an audio synthesizer 408.

The PCI bus interface unit 402 is connected between the PCI bus 320 and two buses internal to the audio wavetable synthesizer 310, specifically a general (GEN) bus 428 and a temporary (TMP) bus 432. The TMP bus 432 is internal to the audio cache 406. The audio cache 406 includes the TMP bus 432, a TMP bus control circuit 442 and a voice data queue 440. The TMP bus control circuit 442 and the voice data queue 440 are connected to the TMP bus 432.

The audio synthesizer 408 is connected to the GEN bus 428 and communicates via the PCI bus 320 through the PCI bus interface unit 402. The audio synthesizer 408 includes a 16-bit synthesizer bus 450 which is connected to the GEN bus 428 by a synthesizer bus interface 452. The audio synthesizer 408 includes a synthesizer bus controller 454, an audio digital signal processor (DSP) 456, a plurality of digital signal processor (DSP) registers 458, a PCI-Audio data controller 460, and an audio static random access memory (SRAM) 462. The audio DSP 456 is connected to the synthesizer bus 450 and connected to the TMP bus 432 of the audio cache 406. The synthesizer bus controller 454, the PCI-Audio data controller 460, and the audio SRAM 462 are connected to the synthesizer bus 450. The DSP registers 458 are connected to the audio DSP 456.

The audio DSP 456 processes the multiple voices of the digital musical signal by performing various known signal processing functions, most fundamentally by performing sample rate conversion and mixing. Sample rate conversion is performed so coordinate the input signal rate of a musical voice signal to an output audio rate since a single output rate is imposed and the input signals commonly may have multiple different sampling rates. For example, the output rate of the audio DSP 456 may be 44.1 kHz while the input rate of a signal such as a telephony-type codec is 8 kHz so that the audio DSP 456 interpolates to generate an output signal at 44.1 kHz.

Furthermore, voice memory is conserved by storing a single voice musical system to represent multiple octaves of a note. The sample rate is converted to provide multiple harmonic key registers to a single stored note. For example, a voice file is typically recorded at the output frequency of the audio DSP 456 (44.1 kHz). A voice signal corresponding to a single key, for example a middle-C, is recorded at 44.1 kHz and saved in the memory so that the sample rate conversion frequency ratio $F_c$ is equal to one. To conserve memory, other harmonics of the voice signal such as a D or E is generated by reading the sample corresponding to a middle-C and converting the sample rate. The output frequency is increased by a full octave for an $F_C$ equal to two, and increased by two octaves for an $F_C$ equal to four.

The sample rate conversion frequency ratio $F_C$ represents the rate at which the audio wavetable synthesizer integrated circuit 310 processes a data file in the system memory 306. Thus, the sample rate conversion frequency ratio $F_C$ is important for determining an favorable size of each queue of the voice data queue 440. If the sample rate conversion frequency ratio $F_C$ is large, data is accessed from the queue at a high rate so a large queue is advantageous for reducing the servicing of the queue. However, if the queue is too large, the audio wavetable synthesizer integrated circuit 310 must include a large amount of memory, disadvantageously increasing the size of the circuit.

The audio wavetable synthesizer integrated circuit 310 processes all of the data for a single voice at one time so that the size of the queue for handling a single voice determines the performance of the audio performance computer system 300. If the queue for storing data for a single voice is small, the audio wavetable synthesizer integrated circuit 310 must frequently request data from the system memory 306, reducing performance by increasing traffic on the PCI bus 320 and delaying processing of audio signals. Using a small queue, performance is audio processing performance is further reduced when the sample rate conversion frequency ratio Fc is large.

The voice data queue 440 is therefore designed in a vertical cache structure having large voice queues but reducing the number of voice queues that are active at one time. In particular, the vertical cache structure includes a substantially reduced set of active voice queues, typically three or four, rather than having an active voice queue for each performed voice. Each of the active voice queues in the vertical cache structure is substantially larger than the voice queues in a system having an active voice queue for each performed voice. In this manner, data communication between the system memory 306 and the audio DSP 456 is greatly reduced while the queue memory size in the audio wavetable synthesizer integrated circuit 310 is not increased.

In the vertical cache structure, the illustrative voice data queue 440 includes four queues instead of having a queue allocated to each voice. Data from the system memory 306 is accessed to fill a single queue at a time so that the audio DSP 456 operates on a plurality of frames in a "frame batch" for each voice at one time. In the illustrative embodiment, a frame batch includes 32 frames. The PCI-Audio data controller 460 requests 32 frames of data for a single voice from the system memory 306. The 32 frames of single-voice data are communicated from the system memory 306 to the voice data queue 440 in a burst mode. The audio DSP 456 processes the 32 frames of data for the single voice and the results are accumulated by the audio DSP 456 and stored in the audio SRAM 462. The PCI-Audio data controller 460 then requests 32 frames of data for a next single voice, progressing through all 32 voices but processing the frame batch data for each voice separately. The PCI bus 320, like most buses, operates more efficiently when data is communicated in a block at one time rather than by transmitting data a single piece at a time. Thus, the vertical cache structure advantageously processes multiple samples of a single voice at one time.

The number of voice queues in the voice data queue 440, typically three or four voice queues, is selected to substantially increase the size of a single voice queue while maintaining the total size of the voice data queue 440 at a reasonable level. Multiple voice queues are implemented so that data is loaded from the system memory 306 to a first voice queue of the voice data queue 440 while data is written from a second voice queue to the audio DSP 456 so that the first voice queue is filled as the data from the second voice queue is processed. More than two voice queues are implemented to assure that the signal processing circuits of the audio DSP 456 remain bus, reducing the possibility that a queue will become empty due to bus latencies or congestion on the PCI bus 320. The latencies involved in communicating data via the PCI bus 320 vary widely and unpredictably based on the specifications and load of the audio performance computer system 300. The processing of the audio DSP 456 proceeds at a generally steady pace while the filling of the queues from them system memory 306 via the PCI bus 320 is highly variable.

The operation of the voice data queue 440 is illustrated by an example in which voice 0 data is previously loaded into a voice queue 0 and is presently accessed by the signal processor circuits of the audio DSP 456. Voice 1 data is filled into voice queue 1 of the voice data queue 440, voice 2 data is filled into voice queue 2, and voice 3 data is filled into voice queue 3 as the voice 0 data is processed by the audio DSP 456. When processing of the voice 0 data is complete, the audio DSP 456 begins processing of the voice 1 data from the voice 1 queue while filling of voice queues 1, 2 and 3 is completed if such filling is not yet completed and voice queue 0 is filled with voice 4 data. In subsequent cycles, voice 5–31 data are filled into the voice data queue 440 and processed. In this manner, data from the system memory 306 is filled into the voice data queue 440 over the PCI bus 320 asynchronously from the processing of the queued data by the audio DSP 456.

Mixing is performed to mix the signals of the multiple voices to create a composite sound. The audio DSP 456 also performs other processing such as separation of a voice into two channels for stereo performance, balancing the signal between different channels, performing three-dimensional localization of multiple output signal channels and other operations.

The DSP registers 458 include an audio DSP system memory address register (ADSMA) and an audio DSP master control register (ADMC). The audio DSP system memory address register (ADSMA) has a format, as follows:

31:0

SAP where SAP is a system address pointer. The system address pointer specifies the system address pointer for master data accesses.

The audio DSP master control register (ADMC) has a format, as follows:

| 15:9 | 8 | 7:6 | 5:0 |
|---|---|---|---|
| Reserved | RdWr_L | TMPqueue | DWCount |

where DWCount is a doubleword (DWORD) count, TMPqueue is a TMP-bus queue number, and RdWr_L is a read-write bit. DWCount specifies the number of double words (DWORDs) to be accessed from system memory 306 in a PCI burst. TMPqueue specifies which of four data queues on the TMP bus 432 is the source or destination of the data. The read-write bit RdWr_L, when reset, specifies that the system memory master access is to originate from the PCI master write data FIFO 420 and be written to system memory 306. The read-write bit RdWr_L, when set, specifies that the system memory access is to originate from system memory 306 and be sent to the PCI master read data FIFO 418.

The PCI bus interface unit 402 includes a bus interface circuit 410, a master state machine 412, and a target state machine 414. The PCI bus interface unit 402 also includes a PCI bus master control unit 416, a PCI master read data FIFO 418, a PCI master write data FIFO 420, a target data to bus converter 422, and configuration registers 424.

The bus interface circuit 410 is directly connected to the PCI interface 320, the master state machine 412 and the target state machine 414. The bus interface circuit 410 includes I/O pad state machines, latches, decoding circuits, parity generation circuits and multiplexers for handling data transfer to the audio wavetable synthesizer 310. The I/O pad state machines of the bus interface circuit 410 are simple controllers for PCI output signals. The master state machine 412 and the target state machine 414 generate control signals for controlling input and output signals of the PCI bus interface unit 402 according to the PCI protocol and track the current state of the PCI bus 320. The bus interface circuit 410, master state machine 412, and target state machine 414 are designed to comply to PCI bus timing rules and generally operate as slaves to the PCI bus 320 and to the PCI bus master control unit 416.

Target data accesses are controlled by the target state machine 414 and pass from the PCI bus 320 through the bus interface circuit 410 to a target address and data (TAD) bus 426. The TAD bus 426 has a width of 32 bits. The target data accesses are passed from the TAD bus 426 to a destination determined by the target address, either the configuration registers 424 on the TAD bus 426 or through the target data to bus converter 422 to the general (GEN) bus 428. The GEN bus 428 conveys target data accesses to the audio DSP 456. The GEN bus 428 has a width of sixteen bits. The target data to bus converter 422 converts 32-bit data from the TAD bus 426 into a 16-bit data form for placement on the GEN bus 428. The target data to bus converter 422 includes configuration registers and decoders for converting the data. Target data accesses are generated by the CPU 302 and controlled by the target state machine 414 to control operations of the audio DSP 456 and the PCI bus master control unit 416.

Master data are passed from the PCI bus 320 through the bus interface circuit 410 to a master address and data (MAD) bus 428. Master data includes wavetable data read from the wavetable memory 200. The MAD bus 430 has a width of 32 bits. Under control of the PCI bus master control unit 416, data is passed from the MAD bus 430 to the GEN bus 428 or to the temporary (TMP) bus 432 through the PCI master read data FIFO 418. The TMP bus 432 carries sample voice data to the voice data queue 440. The TMP bus 432 has a width of 32 bits. Also under control of the PCI bus master control unit 416, data is passed from the GEN bus 428 or from the TMP bus 432 to the MAD bus 430 through the PCI master write data FIFO 420.

The PCI bus master control unit 416 is connected to the MAD bus 430, the GEN bus 428 and the TMP bus 432 for communicating master data. The PCI bus master control unit 416 manages interfacing to the master state machine 412 to initiate master bus cycles. The PCI bus master control unit 416 generates addresses for accessing data in the system memory 306. The PCI bus master control unit 416 includes an array of programmable registers (not shown) which are programmed to generate automatic data access signals to the system memory 306. The PCI bus master control unit 416 then directs the transfer of the accessed data to either the GEN bus 428 or the TMP bus 432. The programmable registers in the PCI bus master control unit 416 are programmed to generating both read and write accesses to the system memory 306. The programmable registers in the PCI bus master control unit 416 are programmed by a system CPU 302 using target accesses and by the audio synthesizer 408. Accordingly, master bus cycles are initiated both from the system CPU 302 and from the audio synthesizer 408.

In the case of master write signals, the PCI bus master control unit 416, when the access is requested, moves data from the buffer of a requesting machine (not shown) on the PCI bus 320 into the PCI master write data FIFO 420. In one example, the PCI bus master control unit 416 moves data from an audio codec record path FIFO (not shown) into the PCI master write data FIFO 420. The PCI bus master control unit 416 then performs a plurality of master bus cycles.

In the case of master read cycles, the PCI bus master control unit 416 first performs the master bus cycles to move data from the system memory 306 into the PCI master read data FIFO 418. Then the PCI bus master control unit 416 moves the data to the buffer of the requesting machine on the PCI bus 320.

The audio wavetable synthesizer 310 includes many features for improving audio performance by increasing data flow from the PCI bus 320 to the audio DSP 456. The highest performance data flowpath is the master data flowpath through the MAD bus 430 and either the PCI master read data FIFO 418 or the PCI master write data FIFO 420, depending on the data flow direction. The master data flow path is isolated from the 16-bit GEN bus 428 and the 16-bit synthesizer bus 450, instead traversing the TMP bus 432 to prevent the buses internal to the audio wavetable synthesizer 310 from choking other system data flow through the audio wavetable synthesizer 310.

The remainder of the data flow, not including the master data flowpath, traverses the GEN bus 428. Target data accesses typically pass through the GEN bus 428 to destinations including the system memory 306 and various internal registers throughout the audio wavetable synthesizer 310. Low bandwidth master data also flows via the GEN bus 428. The synthesizer bus 450 in the audio synthesizer 408 is a separate extension to the GEN bus 428 and forms a primary communication bus for the synthesizer bus controller 454, the audio DSP 456, the PCI-Audio data controller 460, and the audio SRAM 462. The synthesizer bus 450 is isolated from the GEN bus 428 so that data flows over the synthesizer bus 450 without a heavy amount of bus traffic choking the GEN bus 428. Both the GEN bus 428 and the synthesizer bus 450 use the same communication protocol and an identical addressing scheme.

In the described embodiment, the audio DSP 456 includes an audio digital-to-analog converter (DAC) (not shown) operating at a rate of 44,100 samples per second (44.1 kHz). Accordingly, the output data rate of the audio DSP 456 is 44.1 kHz, although the input data rate can be substantially any rate. One sample period is called a frame. A group of 32 samples is called a frame batch. The audio DSP 456 includes two 32-sample stereo accumulators (not shown) for passing data to the audio DAC. As a first audio DAC is updated with the next frame batch for transfer to the audio DAC, a second audio DAC passes current data to the audio DAC.

Nearly all blocks of the audio wavetable synthesizer 310 operate synchronously at the clock rate of the PCI bus 320, typically 33 MHz. The blocks operating at the clock rate of the PCI bus 320 include the PCI bus interface unit 402, the audio synthesizer 408 and all buses. The audio codec 404 and a telephony codec (not shown), which may be included in other embodiments of an audio wavetable synthesizer, operate at various selected rates that are typically based upon a 16.9344 MHz oscillator.

Figure 5:
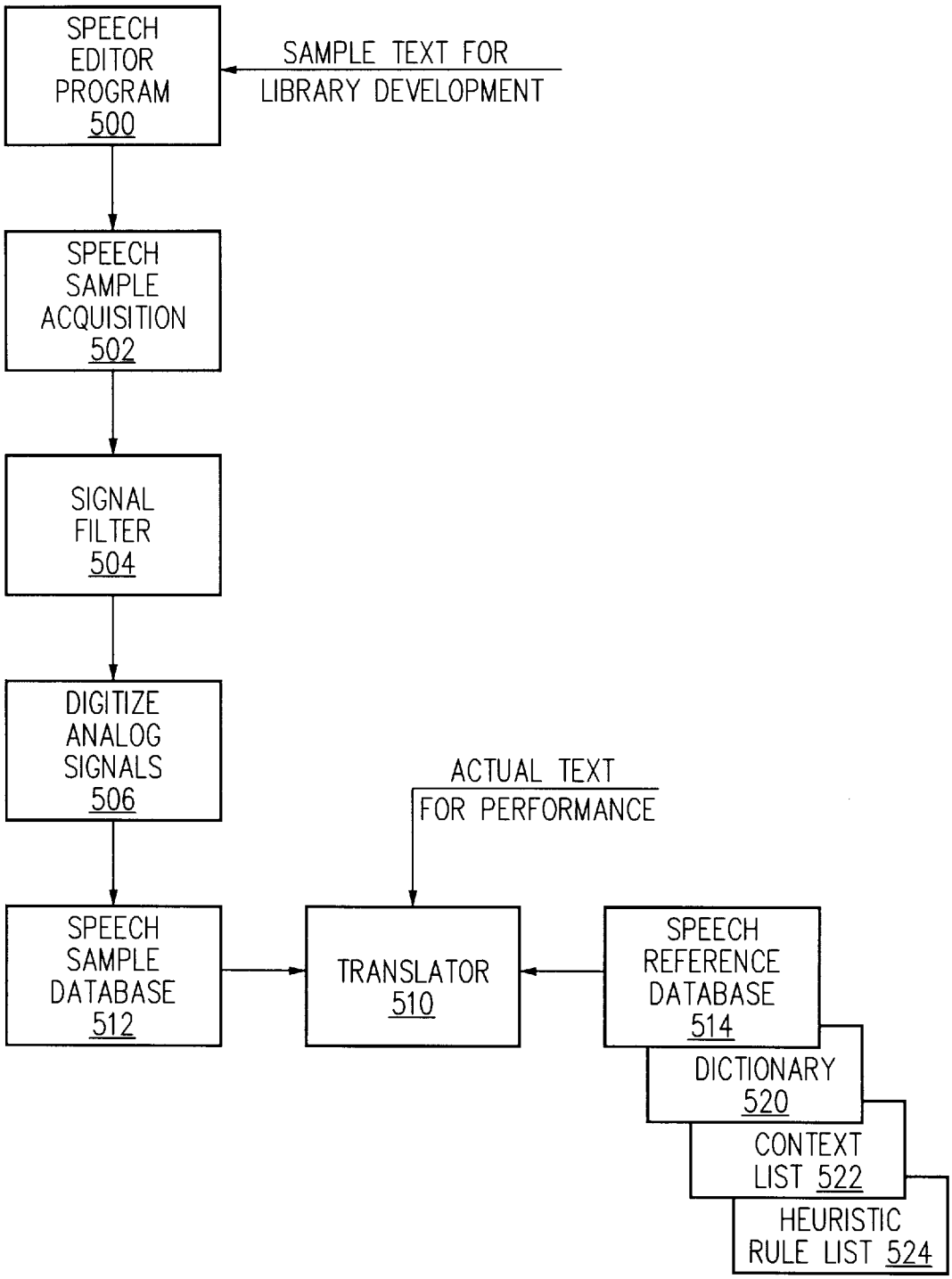
FIG. 5 is a flow chart illustrating an embodiment of a method for coding samples of speech sounds which is performed under the direction of a speech editor program.

Referring to FIG. 5, a flow chart illustrates an embodiment of a method for coding samples of speech sounds, which is performed under the direction of a speech editor program 500. The speech editor program 500 is executed to define a set of primitive speech elements based on input source material such as email, sample text, dictionaries, literature and the like. The speech editor program 500 is typically an interactive program that includes a translator 510 for translating a speech sample database 512 based on a speech reference database 514. The speech reference database 514 typically includes various dictionaries, context lists, algorithms, heuristic rules and the like and is used to make decisions relating to selection of primitive speech element, duration, volume and other parameters.

The speech editor program 500 includes a speech sample acquisition routine 502 for acquiring raw speech samples for storing in the speech sample database 512. The speech sample acquisition routine 502 performs acquisition, processing, and storage of speech samples. The method of the speech sample acquisition routine 502 includes multiple steps including a first step of sensing analog speech signals 502, filtering the signals 504 to constrain the frequency content of the signals to a preselected frequency band, and digitizing the analog signals 506 using an analog-to-digital converter. In some embodiments, the speech signals are digitally filtered following the step of digitizing the analog signals 506 instead of filtering the speech signals using analog filters. In other embodiments, both digital and analog filtering are performed. The step of filtering the signals 504 typically involves low pass filtering of the signal, although high pass filtering is also performed in some embodiments. Filtered signals are stored in the speech sample database 512 for subsequent playback.

The samples stored in the speech sample database 512 form a wavetable memory defining a plurality of primitive speech sounds. The primitive speech elements are individually assigned to memory cells designated by an instrument identification in the wavetable memory. The various primitive speech elements include phonemes or smaller atomic speech elements for general purpose applications, and frequently-occurring syllables and syllables in addition to phonemes for language-specific applications. The primitive speech elements also include sound bites, common names, phrases and words in addition to phonemes for application and language-specific uses. A sound bite is a predefined, variable-size speech signal that is presumed to occur sufficiently frequently to merit a separate storage, thereby saving on reconstruction time during playback and faithfully encoding nuances of speech for reproduction. For special applications, such as voice response systems, the primitive speech elements include instruction sequences, numbers, names and specific responses.

The primitive speech elements generate primitive sounds that are played back at a selected pitch, duration, attack velocity and envelope, sustain, and decay velocity and envelope in the manner of "musical"-type sounds that are produced by conventional wavetable devices. However, in contrast to conventional wavetable synthesizers that store "instrument" samples such as various piano, organ, wind instrument, brass, percussion, and like sounds to produce musical sounds, the speech sample database 512 stores atomic speech sounds.

A sample in the speech sample database 512 may be used to generate an entire repertoire of speech sounds by playing back the samples at different frequencies. Various types of speaker qualities or identities are assigned to different frequency ranges of the speech elements. In one example, the lowest octave is assigned to "grandfather" speech samples. The next lowest octave is assigned to "father" speech samples. Then, in order, "grandmother", "mother", "brother", "sister", and "baby" speech samples are assigned to sequentially higher octaves.

In another example, a sample in the speech sample database 512 may be used to generate a repertoire of different speech sounds expressing various emotional states. A lowest octave is assigned to a voice expressing the emotion of anger. Then, in order, the emotions of surprise, boredom, normalcy, fright, and the like are assigned to sequentially higher octaves. >-a Many differences distinguish the speech sample database 512 from a conventional wavetable memory storing musical instrument notes. One difference is that conventional musical wavetable memories include many different instruments while a much smaller number of speech sounds exist. Therefore, the limited number of speech sounds allows the speech sample database 512 to be exploited by defining a large number of different primitive speech elements including phonemes or smaller atomic speech elements, frequently-occurring syllables, words, complete phrases and sound bites. Accordingly, in the speech processing system primitive speech elements serve as the basic "instruments" for creating simple and complex speech sounds.

Another difference is that musical sounds are typically sustained while speech sounds have a short duration. The short duration of speech sounds is addressed fully by conventional wavetable production which includes "NOTE ON" and "NOTE OFF" commands to commence and terminate a particular note. In speech processing, NOTE ON and NOTE OFF commands typically are requested more frequently than occurs in music synthesis.

A further difference is that speech processing typically does not use as many channels as wavetable synthesis of music. Performance of music generally entails the simultaneous performance of numerous instruments. Accordingly, conventional music synthesizers include multiple channels, commonly 32 channels or more. An illustrative speech synthesis exploits the large number of channels by distributing the speech of a single speaker among a plurality of channels, advantageously generating a crisp speech pattern in which separate sounds are not combined or slurred. Even with a single speaker utilizing a plurality of channels, multiple speakers are accommodated by the multiple channels in a wavetable synthesizer.

The speech reference database 514 includes a dictionary 520 containing storage of sampled words and phonics, and an encoding designating the pronunciation of the words and phonics. The encoding of pronunciation is similar to the pronunciation key of printed dictionaries.

The speech reference database 514 includes a context list 522 encoding emphasis, lift and emotion that are expressed using variations in volume and addition of vibrato and tremolo. For example, the context list 522 may encode declarative statements to be begun louder and slowly reduce volume throughout the statement. The context list 522 may encode questions to finish more softly. The context list 522 encodes large changes in pitch, emphasis, inflection, and primitive element to represent male, female and neuter gender. The context list 522 encodes character of the spoken voice, for example inserting a gruffness or smoothness to speech sounds.

The speech reference database 514 includes a heuristic rule list 524 including algorithms and rules for making decisions concerning selection of primitive speech element, duration, volume, tremolo, vibrato, chorus and flange.

In some embodiments, the speech reference database 514 creates words by manipulating different notes of a single primitive speech element. In other embodiments, the speech reference database 514 creates words by combining sounds from a plurality of primitive speech elements. In a wavetable synthesizer, sounds are created by controlling the timing of transitions between instruments, corresponding to the primitive speed elements of the speech synthesizer. The wavetable synthesizer optimizes the sound of music from note to note of the same instrument. An advantage of forming words from a plurality of different primitive speech elements is that, by combining words from different primitive speech elements, variations from note to note are available to pitch shift the sounds, generating interesting randomness into speech. Multiple primitive speech elements are combined into a word while note variations are used to control speed, emphasis and context. The sounds of speech are further processed by adding tremolo and vibrato. Chorus is added to create the effect of multiple speakers speaking in unison. Flange is added to create a graininess that adds character to some speaking voices.

Figure 6:
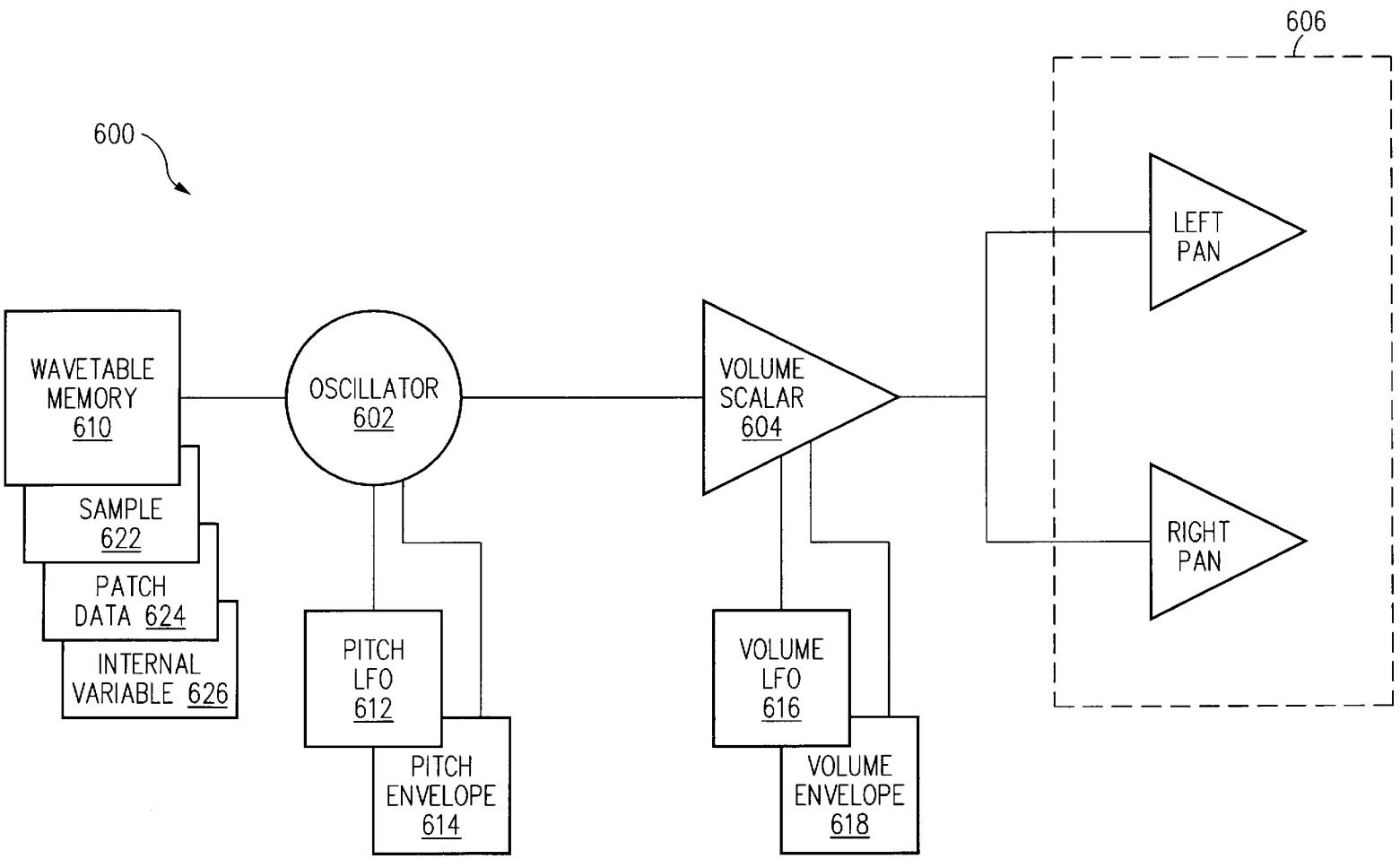
FIG. 6 is a schematic block diagram illustrating a representation of a voice architecture definition.

Referring to FIG. 6, a schematic block diagram illustrates a representation of a voice architecture definition. A voice 600 is a synthesizer structure that is used to generate a speech sound. The voice 600 includes an oscillator 602, a volume scalar 604, and a pan scalar 606. The oscillator 602 is a portion of the voice 600 that reads a sample from a wavetable memory 610.

The synthesizer structure of the voice 600 is used to create speech sounds from a large repertoire of templates. The synthesizer structure of the voice 600 controls the pitch of speech sounds, adds special effects such as vibrato and tremolo to vary the speech sounds generated from a single sample, and ramps the sound volume to higher or lower levels or diminishes the volume in a sustained decay depending on the special effect that is desired. The numerous aspects of wavetable synthesis and wavetable special effects form a rich set of manipulators for speech processing. By applying these manipulators to speech synthesis, the traditionally "raw"-sounding human speech generated by conventional speech synthesizers is replaced by a dramatically improved speech sound that incorporates emotion and dynamics.

The synthesizer structure of the voice 600 advantageously produces a speech pattern that is more realistic than patterns produced by conventional speech synthesizers by allowing sound pitch, duration and volume to be varied as speech progresses.

The oscillator 602 is modified by a pitch low frequency oscillator 612 and a pitch envelope 614. The pitch low frequency oscillator 612 is a periodic waveform, having a range from approximately 0.1 Hz to 50 Hz, that is used to pitch modulate other synthesizer parameters. The pitch low frequency oscillator 612 for speech synthesis has a frequency range extending substantially higher than for conventional music synthesis to support the short time duration of atomic speech elements, the percussive nature of expressive speech, and rapid dynamic range fluctuation that often occurs during speech.

The pitch envelope 614 is an aperiodic waveform that is used to pitch modulate other parameters. The pitch envelope 614 includes a sequence of programmed stages. In one example, an attack stage, a decay stage, a sustain stage, and a release stage are programmed. The attack stage is a rapid initial increase in volume at the beginning of a sound. The decay stage is a reduction in volume from the high initial level. The sustain stage is a fairly constant volume level resulting from vibration. Release is a quick ramp-down of volume when the vibration is damped. A wavetable synthesizer 700, shown in FIG. 7, generates each stage individually. In other examples, additional or fewer stages may be programmed. Each stage segment is individually configured to set the volume function. For example, the individual segments may be configured to ramp up, ramp down, form a forward loop, reverse loop, or bidirectional loop. The ramp rate is programmable with respect to starting point, rate of change, and ending point. When the volume reaches a segment boundary, a maskable interrupt is generated.

The volume scalar 604 is implemented using a digitally-controlled amplifier that determines the amplitude at which the oscillator 602 plays back the samples. The volume scalar 604 is modified by a volume low frequency oscillator 616 and a volume envelope 618. The volume low frequency oscillator 616 is a periodic waveform, having a range from approximately 0.1 Hz to 20 Hz, that is used to volume modulate other synthesizer parameters. The volume envelope 618 is an aperiodic waveform, having the multiple programmed stages like the pitch envelope 614, that is used to pitch modulate other parameters.

Accordingly, the illustrative embodiment of a wavetable synthesizer implements two envelopes per voice, the pitch envelope 614 for pitch modulation and the volume envelope 618 for volume modulation. The pitch envelope 614 or the volume envelope 618 may be looped. The volume envelope 618 is used to implement NOTE ON and NOTE OFF musical instrument digital interface MIDI) messages. Usage of volume envelope 618 for NOTE ON and NOTE OFF messages is preferable to usage of Master Volume programming on the basis that the volume envelope 618 is slewed much more quickly than the offset registers, causing unacceptable delays for sounds having very quick attack and release stages.

Pan describes the location of a sound, generally with respect to a left channel and a right channel, in a stereo field. In the illustrative embodiment, two forms of panning are defined including a static pan and a dynamic pan.

A wavetable memory 620 includes a sample memory 622, a patch data memory 624, and an internal variable memory 626 for usage with the pitch low frequency oscillator 612 and the volume low frequency oscillator 616. The patch data memory 624 is used for storing primitive speech element patches of wavetable data which are swapped in and out of the wavetable memory 610 as desired.

Figure 7:
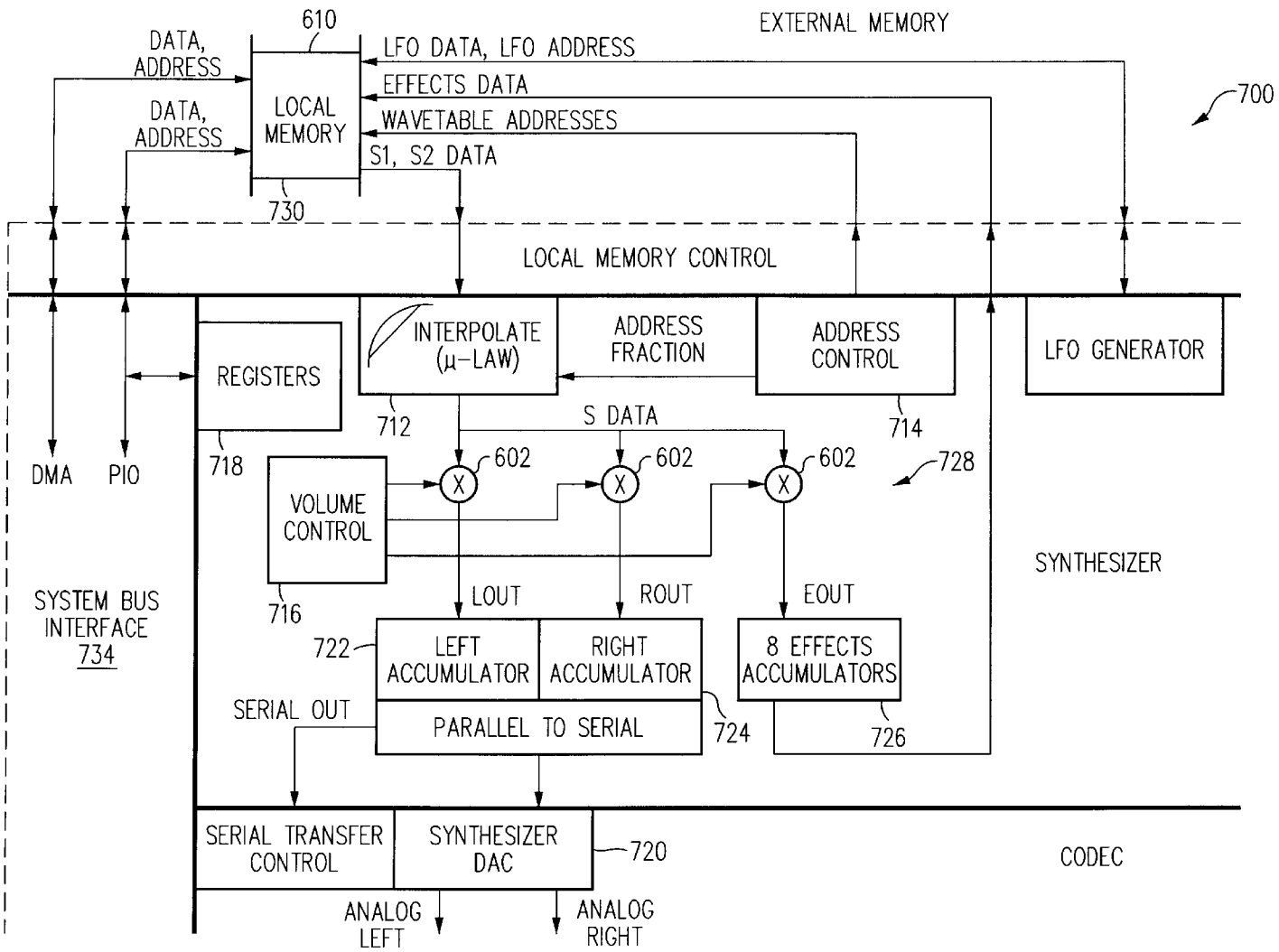
FIG. 7 is a schematic block diagram depicting fundamental signal data paths of a wavetable synthesizer.

Referring to FIG. 7, a schematic block diagram illustrates the fundamental signal data paths of a wavetable synthesizer 700. The wavetable synthesizer 700 processes voices in frames. A sample frame produces one left digital output signal and one right digital output signal which are applied to a synthesizer digital-to-analog converter (DAC) 720. Each sample includes 32 slots with one slot allocated to one voice. During each slot, one voice is individually processed through the signal paths of the wavetable synthesizer 700.

At the beginning of processing of a voice, two samples S1 and S2 are read from a wavetable memory 610 at a selected address. The wavetable address includes an integer portion and a fractional portion. The integer portion addresses S1 sample data and is incremented by 1 to address S2 sample data. A linear interpolator 712 uses the fractional portion for interpolating the sample data S1 and S2. Wavetable data in the wavetable memory 610 may be selectively L-law compressed in which case the samples S1 and S2 are to be expanded prior to interpolation. Sample data is multiplied by volume values that add envelope, low-frequency oscillator (LFO) variation, left and right stereo offset, and effects volume information to produce three output signals including a left output (LOUT) signal, a right output (ROUT) signal, and an effects (EOUT) signal.

Each active voice sums into left and right accumulators 722 and 724 and into selected effects accumulators 726 once during each frame so that the accumulators represent the combined activity of all voices in a frame. The LOUT signal is connected to a left accumulator 722. The ROUT signal is connected to a right accumulator 724. The EOUT signal sums into any, all, or none of eight effects accumulators 726, if effects are enabled. Data from the left accumulator 722 and the right accumulator 724 are output serially to the synthesizer DAC 720 after all voices are processed. Each effects accumulators 726 accumulates any, all, or none of the other voices during a sample frame. The output signals from the effects accumulators 726 are written to a local memory 730 as wavetable for usage by a voice of an effects processor 728. The wavetable synthesizer 700 generates delay-based effects by virtue of the effects processor 728 reading data at a later time.

The wavetable synthesizer 700 supplies a parallel path that allows the output of the effects accumulators 726 to be written as wavetable data to local memory 730 in a conventional manner except that an external digital signal processor (not shown) intercepts the written data and returns the processed data to local memory 730 as wavetable data for the wavetable synthesizer 700. A local memory interface generates timing strobe signals to facilitate the process.

The register array 718 has two types of indirect registers including global registers and voice-specific registers. The global registers affect the operation of all voices while the voice-specific registers only affect the operation of one voice. The register array 718 is a dual-port RAM having one port available to a system bus interface 734 for voice programming and a second port available to a synthesizer engine for voice processing. When the wavetable synthesizer 700 begins to generate a voice, the synthesizer engine reads the programmed values of a voice from the register array 718. At the end of a voice generation, the synthesizer engine writes self-modifying register values back to the register array 718. When the system bus interface 734 attempts to read the register array 718, the access is delayed if the synthesizer engine is currently reading or writing the register array 718. Read access to the register array 718 is improved by using read indices of the synthesizer indirect registers that are different from write indices.

Voice-specific registers are accessed by writing a voice number into a synthesizer voice select register, writing a register index value to a general index register, and writing or reading from a general data port. To read or write several registers in a row for a specific voice, a sequence of register index values are written and a sequence of corresponding read or write accesses are directed to the general data port.

The pitch of a sound is controlled by controlling the address increment during ads playback of wavetable data, thereby determining the playback rate. As wavetable data is read from the wavetable memory 610, a linear interpolator 712 smoothes the wavetable data and inserts missing data values. Interpolation by the linear interpolator 712 is useful for smoothing between vocal atoms in speech synthesis, combining different sounds to produce suitably even speech and constant dynamic balance as sounds are linked over time. Interpolation is also particularly useful for data that is played back at a rate different from the recorded rate. When digital sound data is played back at a rate which is different from the recorded rate, the overall pitch of the sound is altered. Pitch control is programmed using a pitch bend message which selects predetermined pitch bend data and a programmed pitch sensitivity. The pitch control operation is executed in an address controller 714. The pitch bend data and the pitch sensitivity are converted to a pitch bend multiplier that is used to scale the address step in the frequency control register. The scale of the address step in addressing the wavetable memory 610 determines the pitch of a sound. The pitch bend data include a message type and channel number. The pitch bend data also include a position of a "pitch wheel" which serves as an adjustment control between a maximum negative pitch swing and a maximum positive pitch swing. The programmed pitch bend sensitivity scales the pitch range that is contained within the pitch wheel adjustment control data. For a general MIDI operation, the default pitch sensitivity is 2, meaning that the pitch wheel can change the pitch of a synthesizer by up to ±2 semitones (half-steps). After scaling of the pitch wheel, the scaled value is stored and the absolute value is used as a "pitch amount" designating the amount the pitch is to be changed. The pitch amount generally expresses an integer and fractional number of semitones for bending the pitch. The pitch amount is converted to a multiplier for scaling the address step size of a voice.

The volume of a sound is controlled by the volume controller 716. For voices that do not operate as effects processors, the overall volume for a signal path is the combination of three components including the current envelope volume (ENV) plus a current low frequency oscillator volume (LFO) and minus a current offset volume (LPAN, RPAN or FXVOL). For voices that operate as effects processors, the left and right volumes are determined only by the offset volume. The individual voices are processed one voice at a time with each voice being fully calculated and summed into left, right and effects accumulators before sequencing to the next voice. After each component voice is calculated, the overall path volumes are calculated and applied logarithmically to the oscillator 602 to produce the three left, right and effects signal path output signals.

Pan, including both static pan and dynamic pan, is controlled by a volume controller 716 under the direction of program control settings programmed in synthesizer offset registers in the register array 718. For a static pan, a voice is positioned in one of a limited number (for example, 16) predefined stereo positions. The static pan is programmed by writing an attenuation value to a single pan volume offset attenuation register (not shown). In a signal path, the attenuation factor is used to scale the oscillator value of a voice. The attenuation factors are a logarithmic function of the overall volume level of a signal path.

For a dynamic pan, a voice is positioned at any location in a stereo field with the stereo position of the voice being able to change during the duration of a note. Stereo placement is defined by writing attenuation values directly to a right pan volume offset attenuation register and a left pan volume offset attenuation register. The modification of voice position during the duration of a note is achieved by programming a right pan volume offset final value register and a left pan volume offset final value register. Every sample period the attenuation values are incremented or decremented until the current value reaches the programmed final value.

A master volume control is also controlled by the volume controller 716. Volume change messages are typically received while one or more notes are played so that the volume change is to be smoothly applied during the lifetime of the notes. The register array 718 has three programmable registers for directly controlling volume including an envelope volume, a low frequency oscillator volume, and an offset volume. The master volume is controlled by programming the offset volume register including a pan volume offset attenuation register and a master volume offset attenuation register. The attenuation of the left channel is obtained by adding the left channel volume offset to a programmed master volume attenuation. The attenuation of the right channel is obtained by adding the right channel volume offset to the programmed master volume attenuation.

Figure 8:
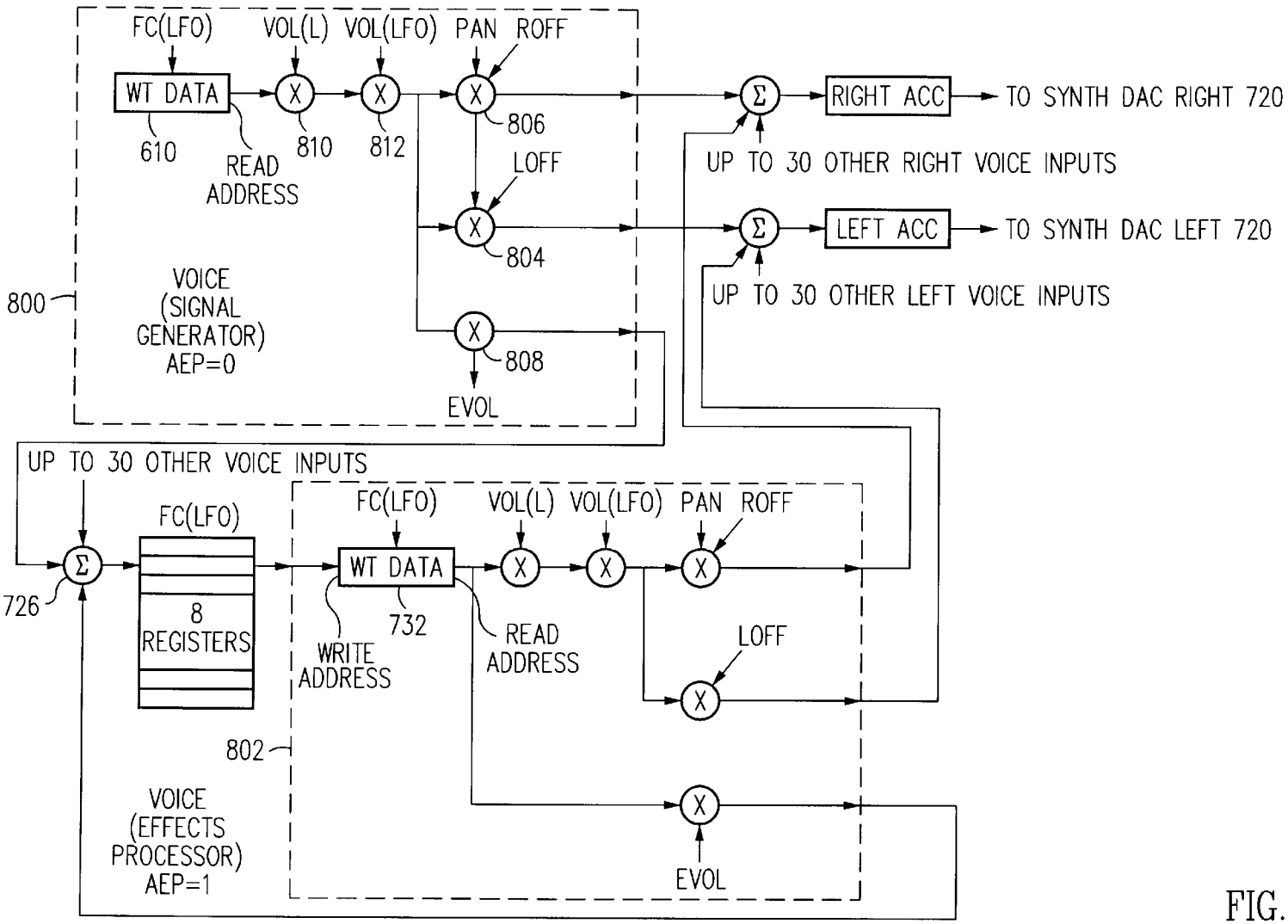
FIG. 8 is a signal flow diagram shows flow of a signal from a first voice to a second voice in which two of 32 available voices are linked as a signal generator voice and an effects processor voice.

Referring to FIG. 8, a signal flow diagram shows flow of a signal from a first voice to a second voice in which two of 32 available voices are linked as a signal generator voice 800 and an effects processor voice 802. An individual voice of the 32 voices is a signal generator voice 800 when an effects processor enable bit of a synthesizer mode register (not shown) is set low for the voice. A signal generator voice 800 plays back recorded data. The input data for a signal generator voice 800 is stored in the wavetable memory 610 and the addressing rate of the wavetable data, which is set using a synthesizer frequency control register (not shown), controls the apparent pitch of the output voice signal. The addressing rate is modified by the low frequency oscillator (LFO) to add vibrato to a tone. Same data read from the wavetable memory 610 is processed by the linear interpolator 712 and passed through a looping volume component 810 and a low frequency oscillator component 812, then passed through left 804, right 806 and effects 808 volume multiplying paths.

The looping volume component 810 performs volume envelope generation and, under register control, is selectively looped and ramped. The low frequency oscillator component 812 adds low frequency oscillator variations in volume resulting in a tremolo effect. Stereo positioning of the voice is controlled by a pan control or through programming of left and right offset values. The left and right offset values are also used to select the total volume control since the left and right volume output signals are summed for the respective left and right volume output signals of all voices, and converted into analog signals by the synthesizer DAC 720.

The effects volume component 808 controls the signal path volume to the effects accumulators 726.

An individual voice of the 32 voices is an effects processor voice 802 when an effects processor enable bit of a synthesizer mode register (not shown) is set high for the voice. The effects processor voice 802 adds delay-based effects to voices. Up to eight of 32 synthesizer voices are software-programmable to produce effects such as reverb, echo, chorus, and flanging. When a voice is performing effects processing, the effects processor voice 802 writes an output signal from one of the effects accumulators 726 to the local memory 730 using a value from a synthesizer effects register as the current write address. The corresponding read address, as with all voices, is the value in a synthesizer address register. The difference between the read address and the write address designates the delay for delay-based effects. The write address increments by 1 and the read address increments by an average of 1 but with time variations imposed by the low frequency oscillator. The time variations generate chorus and flange effects. Volume components in the left path and the right path determine the volume and stereo position of the output signal of the effects processor 728.

An active synthesizer voice generates address and volume boundary interrupts. Upon the occurrence of an interrupt, the type of interrupt and the number of the voice causing the interrupt are read from registers. Multiple voice interrupts are entered and read from a stack (not shown).

The wavetable synthesizer 700 processes up to 32 voices simultaneously in a single frame where a frame is the basic time unit of the wavetable synthesizer 700. During one frame, all 32 voices can be processed and output signals from all frames summed. At the end of a frame, one right output signal and one left output signal are passed to the synthesizer DAC 720. A typical frame rate is 44.1 kHz.

The generation of a voice begins with wavetable data in the local memory 730 addressed by the value in the synthesizer address registers of the register array 718. A next value to be stored in the synthesizer address registers is controlled by (1) an enable PCM operation bit of a synthesizer volume control register, (2) a loop enable bit of the synthesizer address control register, (3) a bidirectional loop enable bit of the synthesizer address control register, and (4) a direction bit of the synthesizer address control register.

PCM operation mode is used to play back digitally-recorded sound samples while using only a small block of memory. The PCM operations controls an address control logic 732 to invoke an interrupt at an address boundary, but to continue moving the address in the same direction unaffected by the address boundary.

The wavetable synthesizer 700 steps through wavetable data stored in the local memory 730. The stored signal directs that the wavetable synthesizer 700 either step directly through the stored data or loop through some range of data. Looping generally reduces the amount of local memory for repetitive wavetable data. The programmed patterns of address control include: (1) a single pass through a sequence of addresses, (2) a forward loop incrementing from a lower address to a higher address, looping to the lower address following the higher address, (3) a reverse loop decrementing from a higher address to a lower address and looping to the higher address following the lower address, (4) bidirectional looping or zigzagging starting at any point, stepping through the memory to an end boundary, then stepping down to the start boundary, and (5) playing back of digital files.

The linear interpolator 712 smoothes voice data as the wavetable synthesizer 700 steps through the wavetable data.

The low frequency oscillator component 812 controls the rate of incrementing or decrementing the synthesizer address register.

TABLE I shows the combinations of wavetable addressing control as affected by a boundary-crossed (BC) internal interrupt flag. If the BC signal is high, an interrupt is generated if enabled. A next address column indicates the expressions used to calculate a next address as a function of ADD (current address value), FC(LFO), START, and END address information.

TABLE I

| Enable PCM Op | Loop Ena | Bidirect Loop Enable | Direct | BC | Next Address |
|---|---|---|---|---|---|
| X | X | X | 0 | 0 | ADD + FC(LFO) |
| X | X | X | 1 | 0 | ADD − FC(LFO) |
| 0 | 0 | X | X | 1 | ADD |
| X | 1 | 0 | 0 | 1 | START − (END − (ADD + FC(FLO))) |
| X | 1 | 0 | 1 | 1 | END + ((ADD − FC(LFO)) − START) |
| X | 1 | 1 | 0 | 1 | END + (END − (ADD + FC(FLO))) |
| X | 1 | 1 | 1 | 1 | START − ((ADD − FC(LFO)) − START) |
| 1 | 0 | X | 0 | X | ADD + FC(LFO) |
| 1 | 0 | X | 1 | X | ADD − FC(LFO) |

During voice generation, the wavetable synthesizer 700 fetches a first sample (SI) from a location in the wavetable memory 610 addressed by the current synthesizer address register. The address is incremented and a second sample (S2) is read from the new location in the wavetable memory 610. The linear interpolator 712 determines an interpolated sample value using an equation, as follows:

$$S = S1 + (S2 - S1) \times \frac{ADDfr}{1024} .$$

The wavetable synthesizer 700 produces a vibrato effect using one of two low frequency oscillators (LFO) assigned to each voice. The LFO produces the vibrato effect by varying the wavetable address increment.

TABLE II shows the combinations of volume control as affected by a boundary-crossed (13C) internal interrupt flag.

TABLE II

| Update Volume | Loop Ena | Bidirect Loop Enable | Direct | BC | Next Address |
|---|---|---|---|---|---|
| 0 | X | X | X | X | VOL(L) |
| 1 | X | X | 0 | 0 | VOL(L) + VINC |
| 1 | X | X | 1 | 0 | VOL(L) − VINC |
| 1 | 0 | X | X | 1 | VOL(L) |
| 1 | 1 | 0 | 0 | 1 | START − (END − (VOL(L) + VINC)) |
| 1 | 1 | 0 | 1 | 1 | END + ((VOL(L) − VINC) − START) |
| 1 | 1 | 1 | 0 | 1 | END + (END − (VOL(L) + VINC)) |
| 1 | 1 | 1 | 1 | 1 | START − ((VOL(L) − VINC) − START) |

The wavetable synthesizer 700 processes low frequency oscillator (LFO) parameters in local memory 730 to update the LFO parameters and produce a final LFO value. The wavetable synthesizer 700 updates one LFO every frame so that 64 frames, called an "LFO frame" are used to update all LFOs. Every eight frames, the waveable synthesizer 700 updates the current position for the depth of one LFO. Therefore, during one LFO frame, the wavetable synthesizer 700 updates the depth position for 8 LFOs. Eight LFO frames make up one "ramp frame" to update the depth of all 64 LFOs.

The wavetable synthesizer 700 makes four accesses of local memory 730 to process one LFO if the depth position is not updated. A control word, a currently-selected depth word, and a currently selected TWAVE word are read in the first three accesses. In the fourth access, a newly calculated TWAVE value is written back to the local memory 730.

Each ramp frame, the wavetable synthesizer 700 compares a depth value to a final depth value and, if the values are different, calculates a ramp time.

A final LFO value modifies either the frequency of the volume of a voice. The wavetable synthesizer 700 stores the final value in a synthesizer frequency LFO register for frequency LFOs and stores the final value in a synthesizer volume LFO for volume LFOs.

Figure 9:
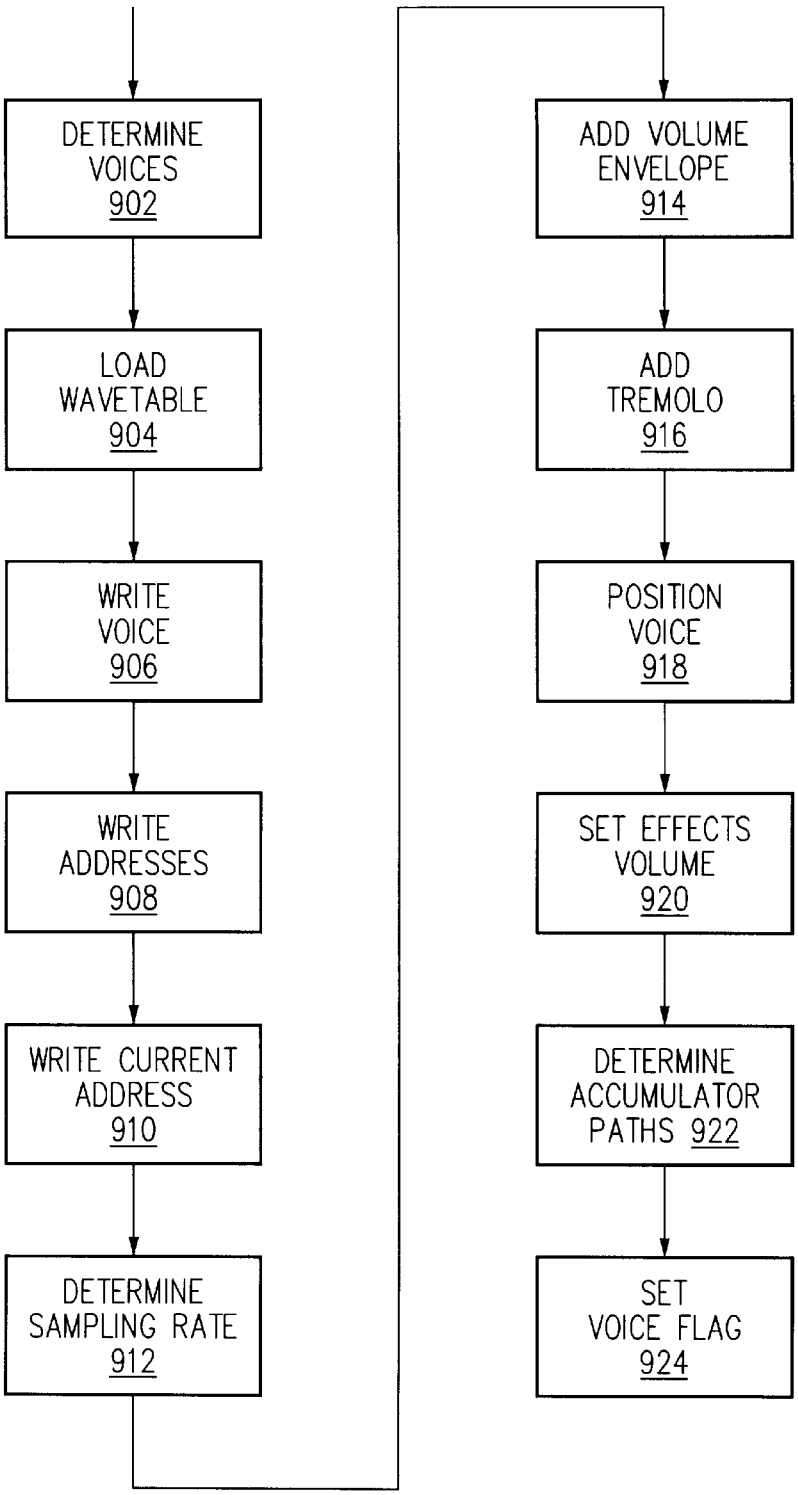
FIG. 9 is a flowchart which illustrates a method for generating sound using signal voices.

Referring to FIG. 9, a flowchart illustrates a method for generating sound using signal voices. In determine voices step 902, the number and identity of voices to produce a desired sound and whether the sound output signal is to be used for effects are determined. In load wavetable step 904, the wavetable data for a determined voice is loaded into local memory 730. In write voice step 906, the value of a voice to be programmed into the wavetable synthesizer 700 is written to the synthesizer voice select register. In write addresses step 908, starting and ending addresses of the voices are written to synthesizer address start and end registers, respectively. Software can read wavetable data from local memory 730 in loops, decreasing the amount of memory for a sustained, unchanging note. Looping is controlled by writing synthesizer volume control and synthesizer address control registers of the register array 718.

In write current address step 910, the address at which a voice is to begin is written to the synthesizer address start registers. Typically, a voice starts at the beginning of the wavetable data allocated to the voice so that the synthesizer address registers and the synthesizer start address registers are the same. The synthesizer start address registers are used for software looping through wavetable data of selected portions of data allowing for sequences of repetitive data to be played from only a small block of local memory 730. In determine sampling rate step 912, the sampling rate for a voice is determined and written to a suitable synthesizer frequency control register. In add volume envelope step 914, the volume envelope for a specified voice is added to the voice. In add tremolo step 916, the wavetable synthesizer 700 adds the tremolo component VOL(LFO). In position voice step 918, the voice is positioned in a stereo field using PAN, LOFF, and ROFF parameters. In set effects volume step 920, the effects volume (EVOL) is set in the synthesizer effects volume register if the output of the voice is to be used for delay-based effects. In determine accumulator paths step 922, the wavetable synthesizer 700 adds the signal voice output signal with other active voices in the frame using the left accumulator 722, the right accumulator 724 and the effects accumulators 726. In set voice flag step 924, the flag designating the current voice as the active voice is set in the synthesizer mode select register.

Figure 10:
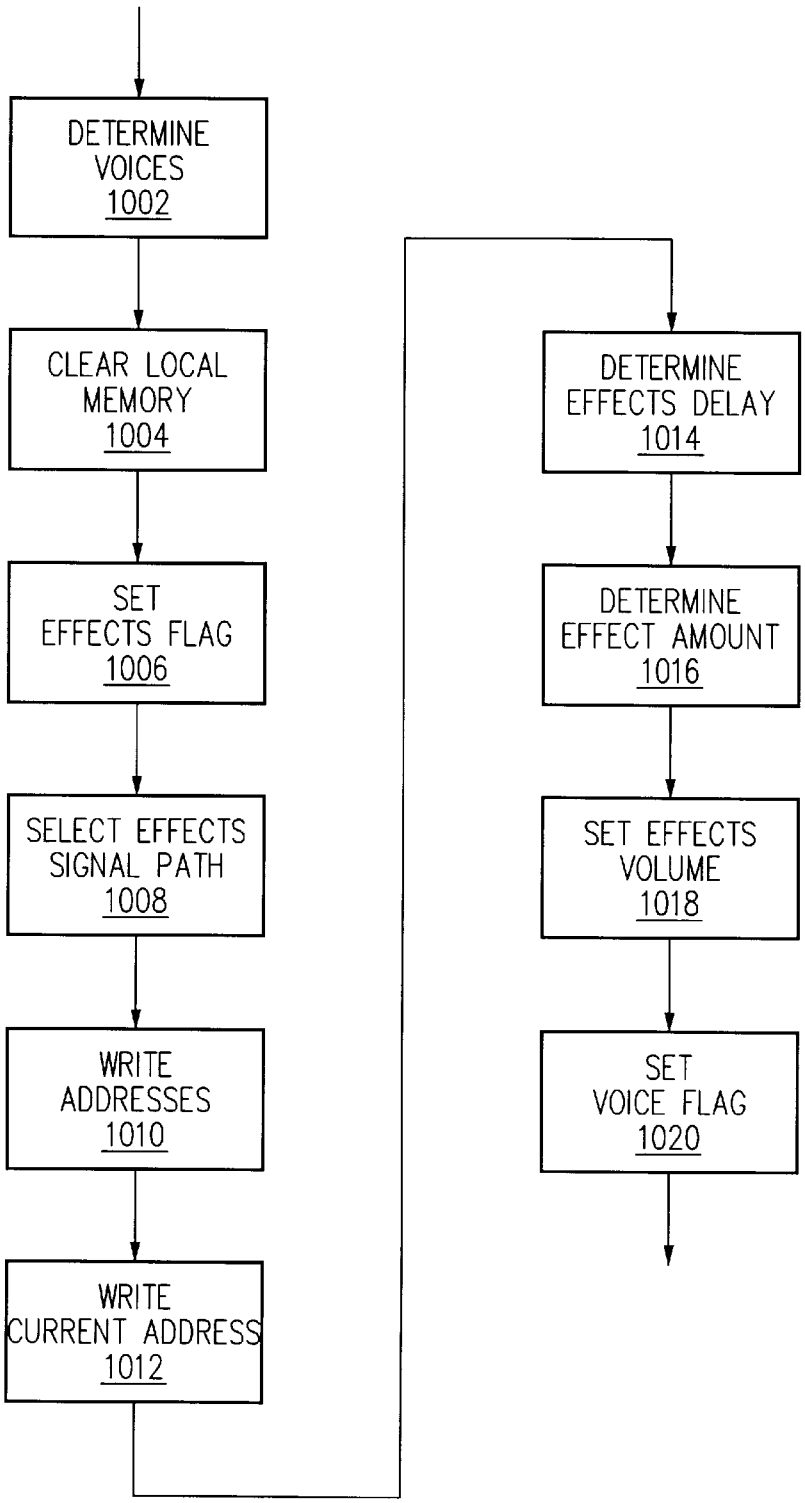
FIG. 10 is a flowchart which illustrates a method for using a voice as an effects processor.

Referring to FIG. 10, a flowchart illustrates a method for using a voice as an effects processor. In determine voices step 1002, the number and identity of voices for usage as effects processors are determined. The output signals of the effects accumulators 726 are linked to specific voices. In clear local memory step 1004, the locations in local memory 730 for usage in effects processing are cleared. In set effects flag step 1006, the flag designating the current voice as an effects processor is set in the synthesizer mode select register. In select effects signal path step 1008, an alternate effects path bit is set to determine the volume components to affect the effects signal path. In write addresses step 1010, starting and ending addresses of the local memory area of the voices are written to synthesizer address start and end registers, respectively. In write current address step 1012, the address at which a voice is to begin is written to the synthesizer address start registers. In determine effects delay step 1014, the difference between the read address and the write address to achieve a desired delay is determined. In determine effect amount step 1016, the amount of effects including volume segments, tremolo, and panning is determined. This path, with full envelope generation, adds left and right accumulators with all other active voices in the frame. In set effects volume step 1018, the effects volume (EVOL) to be fed back to the effects accumulators is set. In set voice flag step 1020, the flag designating the current voice as the active voice is set in the synthesizer mode select register.

While the invention has been described with reference to various embodiments, it will be understood that these embodiments are illustrative and that the scope of the invention is not limited to them. Many variations, modifications, additions and improvements of the embodiments described are possible. For example, one embodiment is described as a system which utilizes a multiprocessor system including an x86 host computer and a speech processor. Another embodiment is described as a system which is controlled by a speech controller for applications of telephone answering machines, low-cost pagers, speech sound generators, and the like. In additional embodiments, a sound synthesizer apparatus may be implemented as an executable program code or software routine operating on a processor to synthesize speech signals. One such embodiment may include a software program operating on an MMX processor to generate speech signals. Other embodiments may include a speech synthesizer implemented in a computer system, a speech synthesizer implemented in a telephone system, a "set-top box" configured as a black box, with or without control buttons, knobs or switches, for connection to a modem to read information such as email or purchased text files. Other embodiments may include black-box type devices for connection to a modem or telephone system for receiving data and transforming the data to speech signals or other codes for communication with the handicapped, the deaf, or the blind.

What is claimed is:

1. A speech synthesis apparatus comprising:

a wavetable synthesizer; and a speech element wavetable memory coupled to the wavetable synthesizer, the speech element wavetable memory storing a plurality of primitive speech sounds for processing on the wavetable synthesizer and generating speech sounds.

2. An apparatus according to claim 1, wherein:

the primitive speech sounds are individually assigned to a memory cell of the speech element wavetable memory designated by an instrument identification.

3. An apparatus according to claim 1, wherein:

the primitive speech sounds selected from among sound bites, entire words and phrases, frequently-occurring syllables, phonemes and smaller atomic speech elements.

4. An apparatus according to claim 1, wherein:

the wavetable synthesizer includes an oscillator, a volume scalar, a pan scalar, and an effects processor for playing back the primitive speech elements at a selected pitch, duration, attack velocity and envelope, sustain, and decay velocity and envelope.

5. An apparatus according to claim 1, wherein:

the speech element wavetable memory includes:

a speech sample database storing a plurality of speech samples; and a speech reference database including a dictionary, a context list, and an heuristic rules list.

6. An apparatus according to claim 5, wherein:

the dictionary stores sampled words and phonics and an encoding designating the pronunciation of the words and phonics; and the context list encodes emphasis, lift and emotion that are expressed using variations in volume and addition of vibrato and tremolo.

7. An apparatus according to claim 5, wherein:

the heuristic rules list includes information for guiding decisions relating to selection of primitive speech element, duration, and volume.

8. An apparatus according to claim 1, wherein:

the primitive speech sounds selected include multiple voices and voices combined with sounds; and the wavetable synthesizer includes multiple channels for creating sounds including the multiple voices and voices combined with sounds simultaneously.

9. A method of synthesizing speech sounds comprising:

storing a plurality of primitive speech sounds in a speech element wavetable memory; and generating speech sounds as a function of the stored plurality of primitive speech sounds using a wavetable synthesizer.

10. A method according to claim 9, wherein:

storing the plurality of primitive speech sounds includes individually assigning the primitive speech sounds to a memory cell of the speech element wavetable memory designated by an instrument identification.

11. A method according to claim 9, wherein:

storing the plurality of primitive speech sounds includes storing primitive speech sounds in the form of sound bites, entire words and phrases, frequently-occurring syllables, phonemes and smaller atomic speech elements; and generating speech sounds as a function of the stored plurality of primitive speech sounds includes selecting from the primitive speech sounds.

12. A method according to claim 9, wherein:

generating speech sounds as a function of the stored plurality of primitive speech sounds includes playing back the primitive speech elements at a selected pitch, duration, attack velocity and envelope, sustain, and decay velocity and envelope using a wavetable synthesizer including an oscillator, a volume scalar, a pan scalar, and an effects processor.

13. A method according to claim 9, wherein:

storing the plurality of primitive speech sounds includes:

storing a plurality of speech samples in a speech sample database; and storing a dictionary, a context list, and an heuristic rules list in a speech reference database.

14. A method according to claim 13, wherein:

storing a dictionary includes storing sampled words and phonics and an encoding designating the pronunciation of the words and phonics; and storing a context list includes encoding emphasis, lift and emotion expressed using variations in volume and addition of vibrato and tremolo.

15. A method according to claim 13, wherein:

storing an heuristic rules list includes storing information guiding decisions relating to selection of primitive speech element, duration, and volume.

16. A method according to claim 9, wherein:

storing primitive speech sounds includes storing multiple voices and voices combined with sounds; and creating sounds including the multiple voices and voices combined with sounds simultaneously.

17. A speech synthesis apparatus comprising:

means for storing a plurality of primitive speech sounds in a speech element wavetable memory; and means coupled to the storing means for generating speech sounds as a function of the stored plurality of primitive speech sounds using a wavetable synthesizer.

18. A computer system comprising:

a processor;

a memory coupled to the processor and storing a plurality of primitive speech sounds in a speech element wavetable memory; and an executable program code executable on the processor for generating speech sounds as a function of the stored plurality of primitive speech sounds using a wavetable synthesizer including an effects processor.

19. A computer system according to claim 18 wherein the processor is an MMX processor.

20. A computer system comprising:

a processor;

means coupled to the processor for storing a plurality of primitive speech sounds in a speech element wavetable memory; and means coupled to the processor and coupled to the storing means for generating speech sounds as a function of the stored plurality of primitive speech sounds using a wavetable synthesizer.

21. A computer system comprising:

a processor; and a speech synthesis apparatus coupled to the processor apparatus including:

a wavetable synthesizer, including an effects processor; and a speech element wavetable memory coupled to the wavetable synthesizer, the speech element wavetable memory storing a plurality of primitive speech sounds for processing on the wavetable synthesizer and generating speech sounds.

22. A telephone system comprising:

a telephone;

a controller coupled to the telephone; and a speech synthesis apparatus coupled to the controller including:

a wavetable synthesizer; and a speech element wavetable memory coupled to the wavetable synthesizer, the speech element wavetable memory storing a plurality of primitive speech sounds for processing on the wavetable synthesizer and generating speech sounds.

23. A communication apparatus comprising:

an interface for connecting to a communication system; and a speech synthesis apparatus coupled to the interface including:

a wavetable synthesizer; and a speech element wavetable memory coupled to the wavetable synthesizer, the speech element wavetable memory storing a plurality of primitive speech sounds for processing on the wavetable synthesizer and generating speech sounds.

24. A communication apparatus according to claim 23 wherein the interface communicates with a modem.

* * * * *